US005781158A

United States Patent [19]

Ko et al.

[11] Patent Number: 5,781,158

[45] Date of Patent: Jul. 14, 1998

[54] ELECTRIC/MAGNETIC MICROSTRIP ANTENNA

[75] Inventors: Young Hoek Ko, #102-1504, Raindongsan APT, Hwajeong-3Dong, Seo-Ku, Rep. of Korea; Hasebe Nozmu, Dgibagen, Japan

[73] Assignee: Young Hoek Ko, Seo-ku Kwangju, Rep. of Korea

[21] Appl. No.: 688,619

[22] Filed: Jul. 30, 1996

Related U.S. Application Data

[63] Continuation-in-part of Ser. No. 558,233, Nov. 17, 1995, abandoned.

[30] Foreign Application Priority Data

Apr. 25, 1995 [KR] Rep. of Korea ..... 95-9761
Apr. 25, 1995 [KR] Rep. of Korea ..... 95-9762

[51] Int. Cl.[6] ..... H01Q 1/38

[52] U.S. Cl. ..... 343/700 MS; 343/848

[58] Field of Search ..... 343/700 MS, 848, 343/815, 817, 846, 833, 834

[56] References Cited

U.S. PATENT DOCUMENTS 4,700,194 10/1987 Ogawa et al. ..... 343/700 MS
5,148,181 9/1992 Yokoyama et al. ..... 343/700 MS
5,173,711 12/1992 Takeuchi et al. ..... 343/700 MS
5,220,335 6/1993 Huang ..... 343/700 MS
5,420,596 5/1995 Burrell et al. ..... 343/848
5,548,297 8/1996 Arai ..... 343/700 MS

*Primary Examiner*—Donald T. Hajec
*Assistant Examiner*—Tan Ho
*Attorney, Agent, or Firm*—Snell & Wilmer

[57] ABSTRACT

Disclosed is an electric/magnetic microstrip antenna 17*a*, 17*b*, 17*c*, 17*d*, 17*e*, 17*f*, 17*g*, and 17*h*. An electric/magnetic antenna 17*a* includes a ground plate 11*a*. A first dielectric substrate 12*a*, a patch radiator 13*a*, a second dielectric substrate 14*a*, parallel plates 15*a*, 15*b* are sequentially stacked on the ground plate 11*a*. The ground plate 11*a* and the patch radiator 13*a* have the same width(W1) and the parallel plates 15*a* and 15*b* are formed by folding up both ends of the ground plate 11*a* such that the size of the electric/magnetic microstrip antenna is reduced while the range of electric lines of force between the patch radiator 13*a* and the ground plate 11*a* is not restricted. The outer conductor of a feeder 16*a* is connected with the ground plate 11*a*, and the inner conductor of the feeder 16*a* is connected with the patch radiator 13*a* through the ground plate 11*a*.

8 Claims, 13 Drawing Sheets

ELECTRIC/MAGNETIC MICROSTRIP ANTENNA

CROSS REFERENCE TO RELATED APPLICATION

This application is a continuation-in-part of application Ser. No. 08/558,233, filed Nov. 17, 1995, now abandoned.

BACKGROUND OF THE INVENTION

1. Field of the Invention

The present invention relates to an electric/magnetic microstrip antenna MSA. More particularly, the present invention relates to an electric/magnetic microstrip antenna which improves transmit-receive sensitivity, has a small size, and is simple in structure by the fact that a matching circuit can be eliminated when the electric/magnetic microstrip antenna is attached to a portable radio equipment.

2. Description of the Prior Art

Generally, a microstrip antenna has a flat profile; and consists of a dielectric substrate stacked on a ground plate, and a rectangular or circular patch radiator stacked on the dielectric substrate. Although the microstrip antenna has some disadvantages compared to a conventional microwave antenna including narrow bandwidth and loss, hence somewhat lower gain; the microstrip antenna has peculiar advantages including low fabrication cost, small size, and light weight to afford mass production.

The advantages of the microstrip antenna far outweigh their disadvantages. Since the microstrip antenna is capable of being freely bent, the microstrip antenna can be wound onto a device or a part which moves at high speed, to be applied to a flying objects such as missiles, rockets, aircraft.

The microstrip antenna are compatible with modular designs; and solid state devices such as oscillators, amplifiers, variable attenuators, switches, modulators, mixers, phase shifters, etc. can be directly added to the antenna substrate. By putting one or more feeding point at the rectangular or circular patch radiator, the microstrip antenna can be used in satellite communication which demands circularly polarized wave.

Some notable system applications for which microstrip antennas have been developed include doppler and other radars, radio altimeter, command and control, missile telemetry, weapon fuzing, manpack equipment, environmental instrumentation and remote sensing, feed elements in complex antennas, satellite navigation receiver, biomedical radiator, etc.; and the number of applications continues to grow.

Recently, as information networks grow, a mobile communication terminal unit such as car telephone, pocket bell, cordless telephone, etc. is being rapidly distributed in the market; and in step with the miniaturization of the terminal unit, antennas must necessarily be miniaturized. Accordingly, the antennas are being required to have small size, light weight, and compact structure.

Presently developed microstrip antennas include quarter-wavelength microstrip antenna QMSA, post-loading microstrip antenna PMSA, window-attached microstrip antenna WMSA, and frequency-variable microstrip antenna FVMSA. The PMSA, WMSA, and FVMSA antennas are the things which are partially modified from the QMSA antenna and which have similar radiation patterns.

Generally, as shown in FIG. 1, the QMSA antenna consists of a dielectric substrate 22 which is stacked on a ground plate 21 having length of a half of guide wavelength μg, and a patch radiator 23 stacked on the dielectric substrate 22. One side of the ground plate 21 is shorted, and the length of the patch radiator 23 is limited to μg/4. The ground plate 21 is connected with the outer conductor of a feeder 24, and the inner conductor of the feeder 24 is connected with the patch radiator 23 through the ground plate 21 and the dielectric substrate 22. The materials of the dielectric substrate 22 includes for example, polyethylene( ε r=2.4), Teflon (polytetra-fluoroethylene) (ε r=2.5) or epoxy-fiberglass( ε r=3.7).

FIG. 2 shows the relation between Gz and the gain for the QMSA antenna of FIG. 1, and 0 dB means the gain of a basic half-wave dipole antenna.

FIG. 3 shows the relation between total length L and the gain for the QMSA antenna of FIG. 1; and FIG. 4 shows the relation between patch width W and the gain for the QMSA antenna of FIG. 1.

Referring to FIGS. 5A to 5C, there are illustrated diagrams showing the radiation characteristic of the QMSA antenna of FIG. 1, in which FIG. 5A is XY direction, FIG. 5B is YZ direction, and FIG. 5C is ZX direction. By observing the radiation pattern of FIGS. 5A to 5C, it is to be readily understood that the QMSA antenna is omnidirectional antenna which propagates radio wave in omnidirection. However, when the distribution of standing wave is positioned adjacent a minimum point in complicated urban communities, the transmit-receive sensitivity of the omnidirectional antenna is reduced by the diffraction and reflection of signal, and the quality of communication is deteriorated. To overcome the above problem, current mobile communication terminal systems use space diversity, directional diversity, polarization diversity, etc.; and at least two antennas are installed to resolve lower receive sensitivity due to multipath.

The radiation characteristic of FIGS. 5A to 5C is come out when the total length of QMSA antenna L=7.67 cm, Gz=2.79 cm, width of the patch radiator 23 W=3.0 cm, thickness of the dielectric substrate 22 t=0.12 cm, and permittivity ε r=2.5(Teflon).

However, presently developed microstrip antennas, namely QMSA, PMSA, WMSA, and FVMSA antennas have disadvantages in that miniaturization is impossible because radiation opening area becomes narrower when the ground plate is made small, that field strength is reduced by the wall of a building or metallic material in case of portable mobile communication terminal system using omnidirectional antenna, and that receive sensitivity is reduced due to multipath interference.

SUMMARY OF THE INVENTION

Accordingly, the present invention has been made in view of the above-described problems occurring in the prior art, and an object of the present invention is to provide an electric/magnetic microstrip antenna which improves transmit-receive sensitivity, has a small size, is simple in structure by the fact that a matching circuit can be eliminated when the electric/magnetic microstrip antenna is attached to a portable radio equipment, can be embedded into a transmit-receive equipment, can have double frequency when being used as a line antenna having a ground plate in common, and can adjust the interval of transmit frequency and receive frequency.

According to one aspect of the present invention, there is provided an electric/magnetic microstrip antenna comprising:

a ground plate;

a first dielectric substrate and a patch radiator sequentially stacked on the ground plate; and a second dielectric substrate and a pair of parallel plates which are spaced each other, sequentially stacked on the patch radiator to form a capacitance between the patch radiator and the respective parallel plates;

wherein the ground plate and the patch radiator have the same width, and wherein the parallel plates are formed by connecting both ends of the ground plate such that the size of the electric/magnetic microstrip antenna is reduced while the range of electric lines of force between the patch radiator and the ground plate is not restricted.

According to another aspect of the present invention, there is provided an electric/magnetic microstrip antenna comprising:

a ground plate;

a first dielectric substrate and a patch radiator sequentially stacked on the ground plate;

a second dielectric substrate and a first parallel plate sequentially stacked on the upper surface of the patch radiator adjacent one end of the antenna, to form a capacitance between the patch radiator and the first parallel plate; and a third dielectric substrate and a second parallel plate sequentially stacked below the lower surface of the ground plate adjacent the other end of the antenna, to form a capacitance between the ground plate and the second parallel plate;

wherein the ground plate and the patch radiator have the same width, and wherein the first parallel plate is formed by connecting one end of the ground plate and the second parallel plate is formed by connecting one end of the patch radiator such that the size of the electric/magnetic microstrip antenna is reduced while the range of electric lines of force between the patch radiator and the ground plate is not restricted.

According to another aspect of the present invention, there is provided an electric/magnetic microstrip antenna comprising:

a dielectric substrate;

a patch radiator and a first parallel plate spacedly stacked on the upper surface of the dielectric substrate to form a capacitance therebetween; and a ground plate and a second parallel plate spacedly stacked below the lower surface of the dielectric substrate to form a capacitance therebetween;

wherein the ground plate and the patch radiator have the same width, and wherein the first parallel plate is formed by connecting one end of the ground plate and the second parallel plate is formed by connecting one end of the patch radiator such that the size of the electric/magnetic microstrip antenna is reduced while the range of electric lines of force between the patch radiator and the ground plate is not restricted.

According to another aspect of the present invention, there is provided an electric/magnetic microstrip antenna comprising:

a ground plate;

a first dielectric substrate and a pair of patch radiators which are spaced each other, sequentially stacked on the ground plate;

a pair of second dielectric substrates and a pair of first parallel plates sequentially stacked on the upper surface of the respective patch radiator adjacent one end of the antenna, to form a capacitance between the patch radiators and the first parallel plates; and a pair of third dielectric substrates and a pair of second parallel plates sequentially stacked below the lower surface of the ground plate adjacent the other end of the antenna, to form a capacitance between the ground plate and the respective second parallel plates.

wherein the first parallel plates are formed by connecting one end of the ground plate and the second parallel plates ares formed by connecting one end of the patch radiator such that the size of the electric/magnetic microstrip antenna is reduced while the range of electric lines of force between the patch radiator and the ground plate is not restricted.

According to another aspect of the present invention, there is provided an electric/magnetic microstrip antenna comprising:

a ground plate;

a first dielectric substrate and a patch radiator sequentially stacked on the ground plate; and a second dielectric substrate and two pairs of parallel plates which are opposedly spaced each other, sequentially stacked on the upper surface of the patch radiator to form a capacitance between the patch radiator and the respective parallel plates;

wherein the ground plate and the patch radiator have the same width, and wherein the first and the second parallel plates are formed by connecting both ends of the ground plate such that the size of the electriicmagnetic microstrip antenna is reduced while the range of electric lines of force between the patch radiator and the ground plate is not restricted.

According to another aspect of the present invention, there is provided an electric/magnetic microstrip antenna comprising:

a ground plate;

a dielectric substrate stacked on the ground plate;

a pair of parallel plates which are stacked on the dielectric substrate and spaced each other; and a patch radiator which is stacked on the dielectric substrate and positioned between the parallel plates to form a capacitance between the parallel plates and the patch radiator;

wherein the ground plate and the patch radiator have the same width, and wherein the parallel plates are formed by connecting both ends of the ground plate such that the size of the electric/magnetic microstrip antenna is reduced while the range of electric lines of force between the patch radiator and the ground plate is not restricted.

According to another aspect of the present invention, there is provided an electric/magnetic microstrip antenna comprising:

a ground plate;

a dielectric substrate stacked on the ground plate; and a patch radiator and a parallel plate spacedly stacked on the upper surface of the dielectric substrate to form a capacitance therebetween;

wherein the ground plate and the patch radiator have the same width, and wherein the parallel plate is formed by connecting one end of the ground plate and the patch radiator is formed by connecting the other end of the ground plate such that the size of the electric/magnetic microstrip antenna is reduced while the range of electric lines of force between the patch radiator and the ground plate is not restricted.

According to still another aspect of the present invention, there is provided an electric/magnetic microstrip antenna comprising:

a ground plate;

a first dielectric substrate and a patch radiator sequentially stacked on the ground plate, one end of the ground plate being shorted electrically; and a second dielectric substrate and a pair of parallel plates which are spaced each other, sequentially stacked on the patch radiator to form a capacitance between the two parallel plates;

wherein the ground plate and the patch radiator have the same width, and wherein the parallel plates are formed by connecting both ends of the ground plate such that the size of the electric/magnetic microstrip antenna is reduced while the range of electric lines of force between the patch radiator and the ground plate is not restricted.

By the features of the present invention, because both ends of a ground plate are folded to form a capacitance, an electric/magnetic microstrip antenna of the present invention has a small size.

Since the antenna has a symmetrical construction, the leaking current cannot be flowed into the outer conductor of the coaxial cable of a feeder. Since the antenna function as a antenna having two feed points the one of which can be used for transmit and the other one of which can be used for receive; perceiving the fact that when electric field strength is minimum, magnetic field strength is maximum; lower receive sensitivity problem due to multipath is resolved.

The antenna can be miniaturized by the fact that the ground plate and the patch radiator have the same width and the left/right parallel plates are formed by connecting both ends of the ground plate or by connecting one end of the ground plate and one end of the patch radiator thereby micro-spherical loop structure is defined. Since phase field is created at the both end portions of the antenna, bandwidth is increased as compared to the case in which phase field is created at one end portion. Since vertically polarized wave and horizontally polarized wave are simultaneously created, transmit-receive efficiency is improved.

In the present invention, a feed point is adjusted from one side of the ground plate for impedance matching, and the inner conductor of a feeder is passed through the ground plate to be connected with a patch radiator to excite.

Also, in the present invention, since capacitance is formed between the patch radiator and a pair of parallel plates, when the antenna is installed to a partable mobile communication system, a matching circuit is not needed.

BRIEF DESCRIPTION OF THE DRAWINGS

The above object, and other features and advantages of the present invention will be more apparent after a reading of the following detailed description taken in conjunction with the drawings, in which:

FIGS. 5A to 5C are diagrams showing the radiation characteristic of the QMSA antenna of FIG. 1, in which FIG. 5A is XY direction, FIG. 5B is YZ direction, and FIG. 5C is ZX direction;

FIGS. 8A to 8C are diagrams showing the radiation characteristic of the electric/magnetic microstrip antenna of FIG. 6, in which FIG. 8A is YZ direction, FIG. 8B is YX direction, and FIG. 8C is ZX direction;

DETAILED DESCRIPTION OF THE PREFERRED EMBODIMENT

Hereinafter, electric/magnetic microstrip antennas in accordance with embodiments of the present invention will be described with reference to the drawings.

EXAMPLE 1

Figure 1:
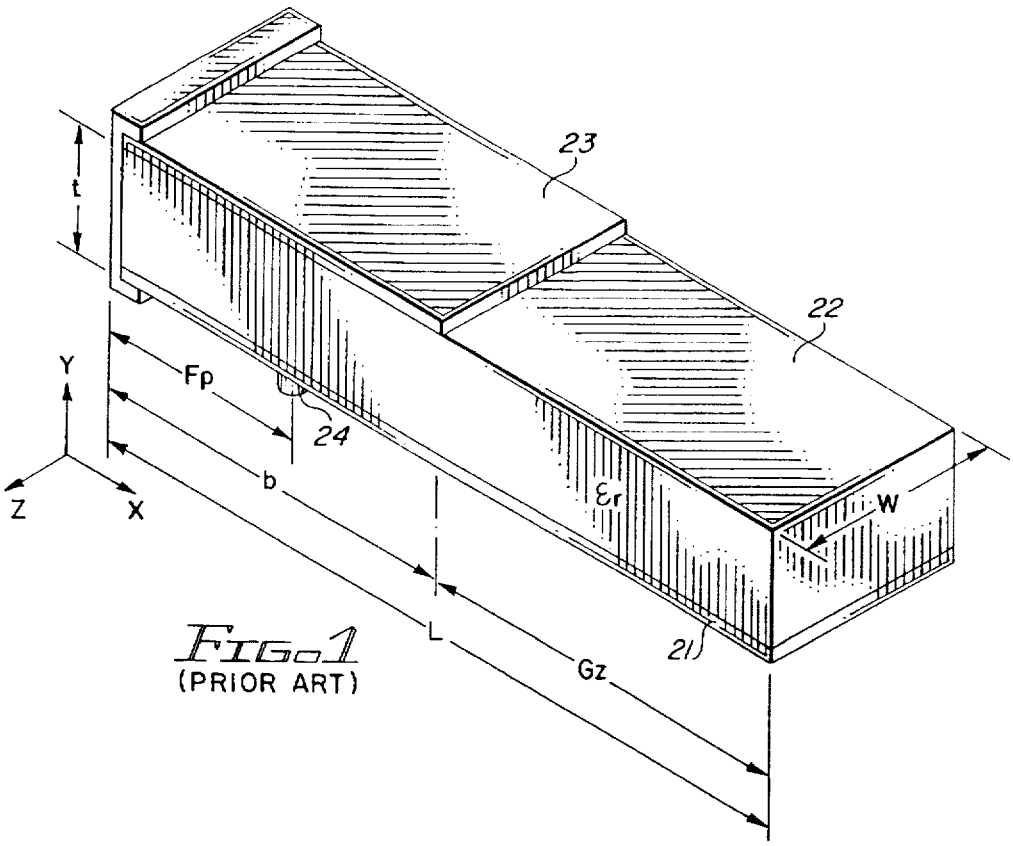
FIG. 1 (PRIOR ART)
FIG. 1 is a perspective view illustrating a QMSA antenna of the prior art.
Figure 2:
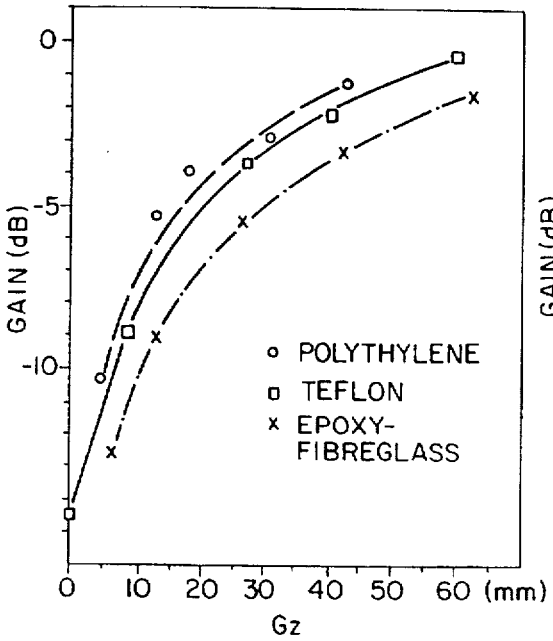
FIG. 2 (PRIOR ART)
FIG. 2 is a graph showing the relation between Gz and the gain for the QMSA antenna of FIG. 1.
Figure 3:
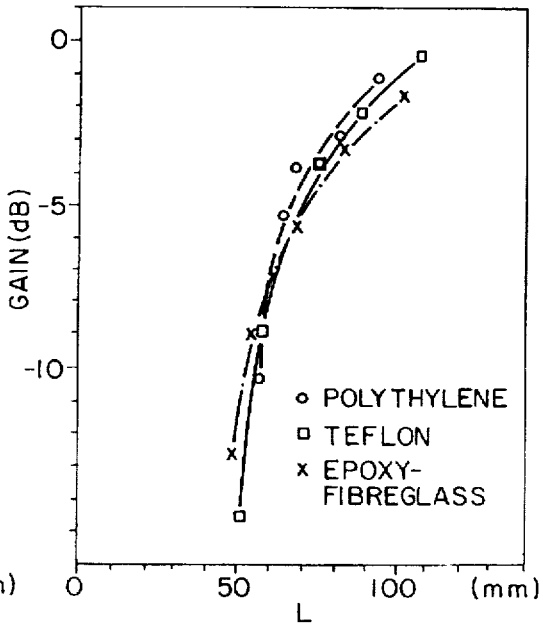
FIG. 3 (PRIOR ART)
FIG. 3 is a graph showing the relation between total length L and the gain for the QMSA antenna of FIG. 1.
Figure 4:
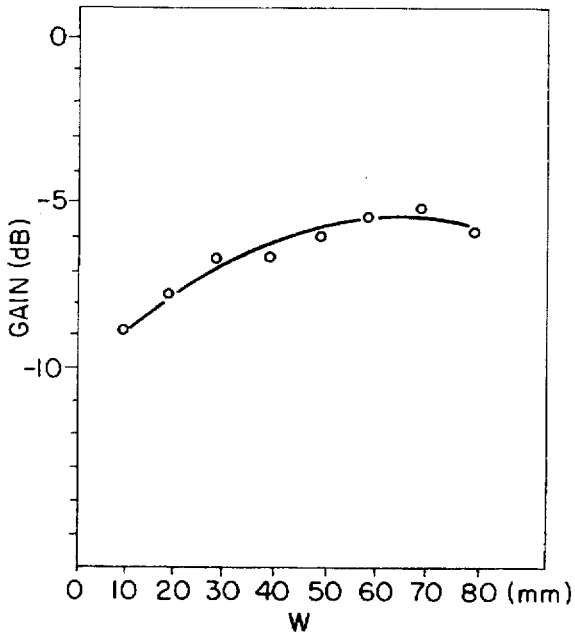
FIG. 4 (PRIOR ART)
FIG. 4 is a graph showing the relation between patch width W and the gain for the QMSA antenna of FIG. 1.
Figure 5A:
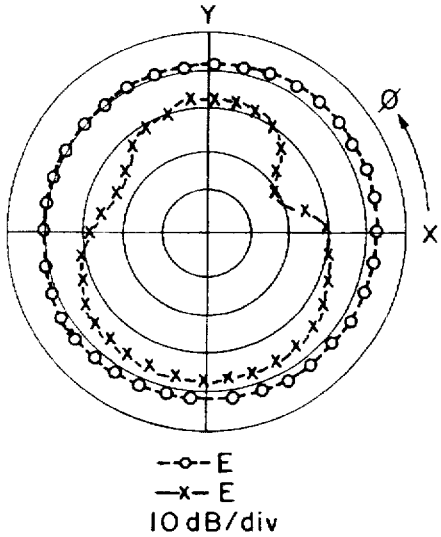
FIG. 5A (PRIOR ART)
Figure 5B:
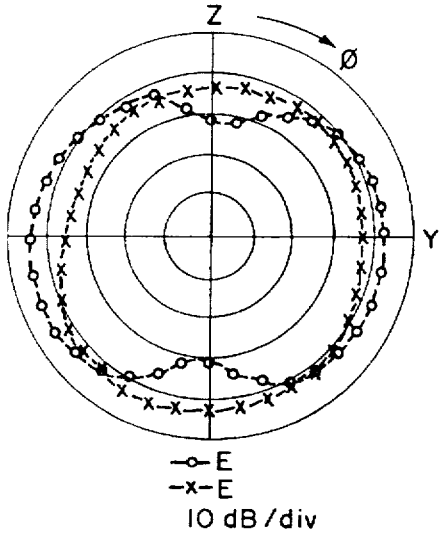
Figure 6:
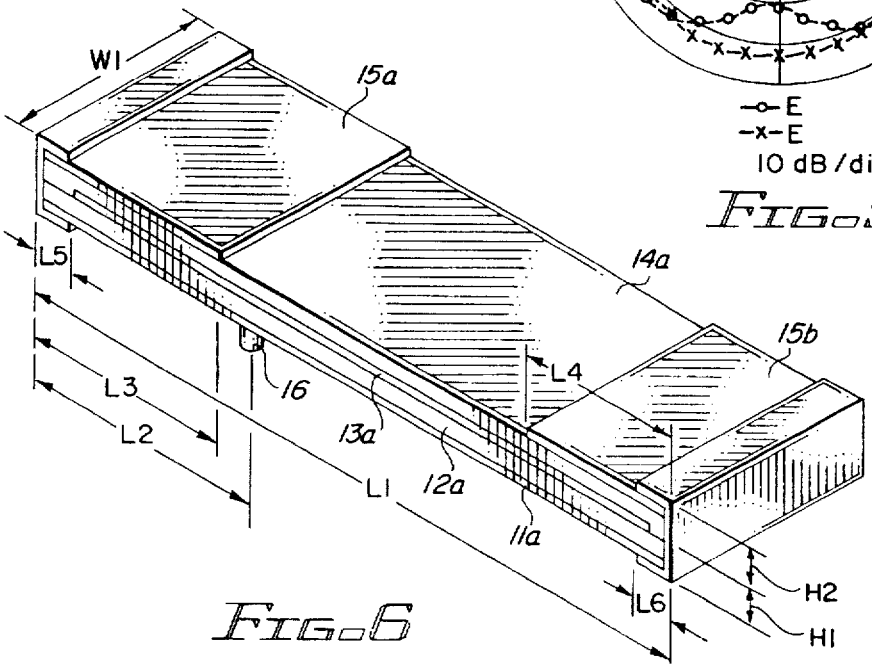
FIG. 6 is a perspective view illustrating an electric/magnetic microstrip antenna in accordance with an embodiment of the present invention.
Figure 5C:
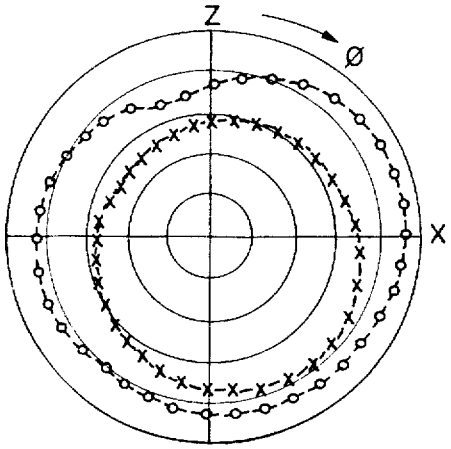
FIG. 5C (PRIOR ART)

Referring now to FIG. 6, there is illustrated a perspective view of an electric/magnetic microstrip antenna in accordance with a first embodiment of the present invention. As shown in FIG. 6, an electric/magnetic antenna 17*a* includes a ground plate 11*a*. A first dielectric substrate 12*a* and a patch radiator 13*a* are sequentially stacked on the ground plate 11*a*. A second dielectric substrate 14*a* is stacked on the patch radiator 13*a*, and parallel plates 15*a*, 15*b* having same width are spacedly stacked on the second dielectric substrate 14*a*. The outer conductor of a feeder 16*a*is connected with the ground plate 11*a*, and the inner 15 conductor of the feeder 16*a* is connected with the patch radiator 13*a* through the ground plate 11*a*.

In the above construction, dimensions are defined as follows:

- the thickness t of the ground plate 11*a*, the patch radiator 13*a*, and the left/right parallel plate 15*a*, 15*b*=0.0035 cm,
- total length L1 of the antenna 17*a*=2.7 cm,
- the length L2 between the left end of the antenna 17*a* and the center of the inner conductor of the feeder 16*a*=0.95 cm, the length L3 between the left end of the antenna 17*a* and the right end of the left parallel plate 15*a*=0.8 cm,
- the length L4 between the right end of the antenna 17*a* and the left end of the right parallel plate 15*b*=1.2 cm,
- the length L5, L6 between the left/right end of the patch radiator 13*a* and the left/right end of the antenna 17*a*=0.2 cm,
- the width W1 of the antenna 17*a*=2.7 cm,
- the height H1 between the ground plate 11*a* and the first dielectric substrate 12*a*=0.1575 cm, the height H2 between the patch radiator 13*a*, the second dielectric substrate 14*a*, and the parallel plate 15*a*, 15*b*=0.1575 cm, and
- frequency f=2.0 GHz(ε=15 cm).

Figure 7:
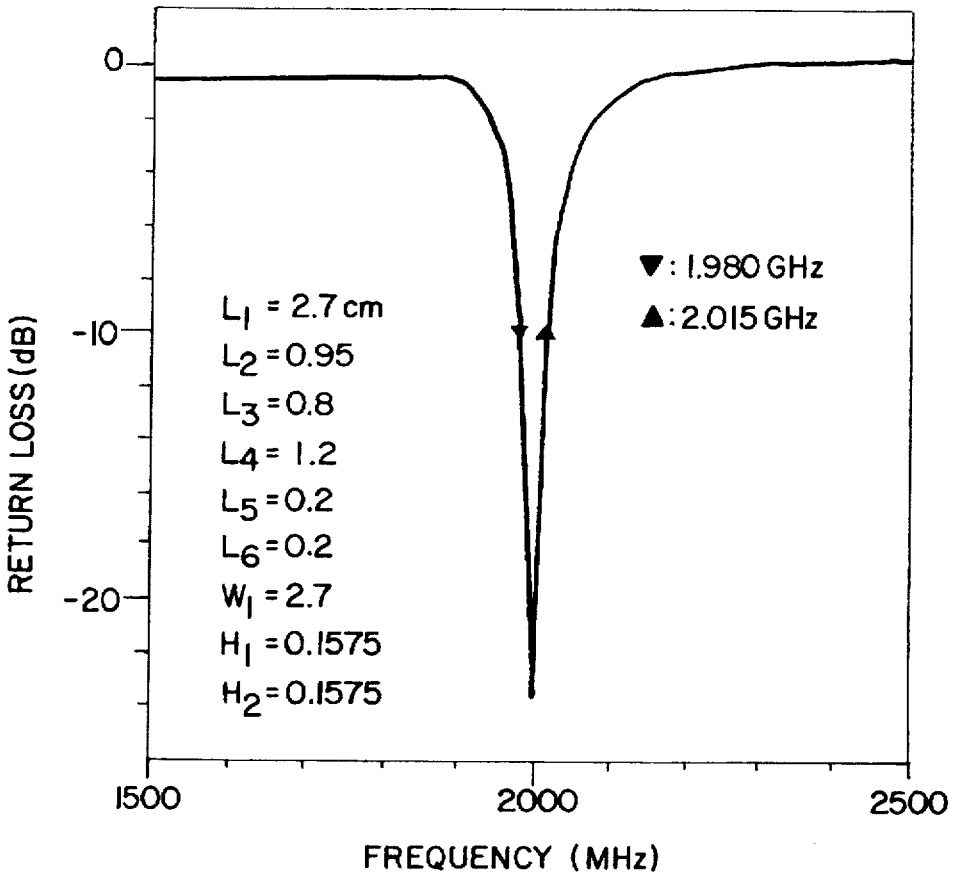
FIG. 7 is a graph showing the return loss property of the electric/magnetic microstrip antenna of FIG. 6.

FIG. 7 shows the return loss property of the electric/magnetic microstrip antenna of FIG. 6; and it is to be understood that when frequency of 2.0 GHz is used, 25 dB is obtained and bandwidth is 1.7%.

Figure 8A:
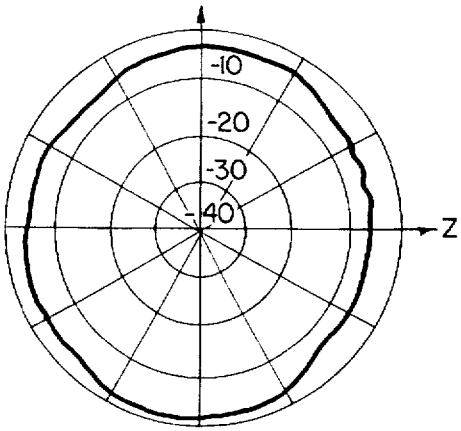
Figure 8B:
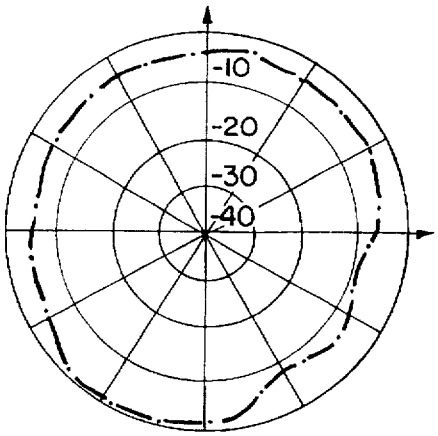
Figure 8C:
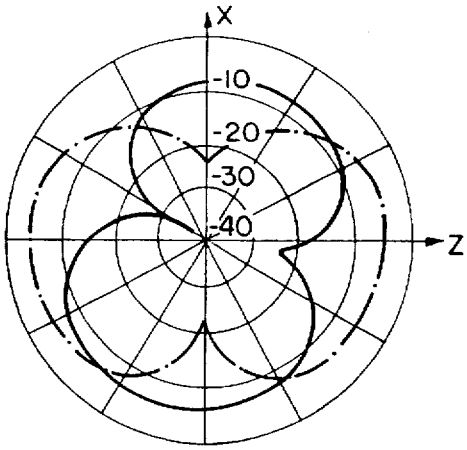

FIGS. 8A to 8C are diagrams showing the radiation characteristic of the electric/magnetic microstrip antenna of FIG. 6, in which FIG. 8A is YZ direction, FIG. 8B is YX direction, and FIG. 8C is ZX direction. From the FIGS. 8A to 8C, it is possible to know relative gain as compared to the conventional dipole antenna.

Figure 9:
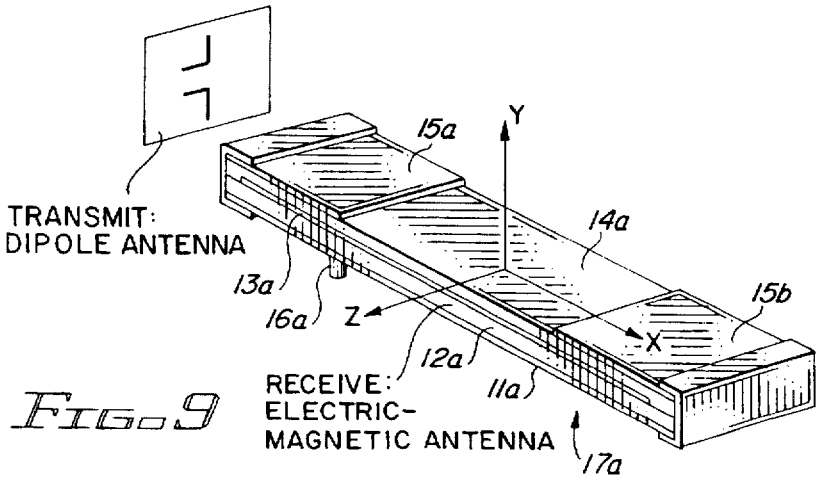
FIG. 9 is a perspective view schematically illustrating the method for measuring the radiation characteristic in each case of FIGS. 8A to 8C.

FIG. 9 is a perspective view schematically illustrating the method for measuring the radiation characteristic in each case of FIGS. 8A to 8C.

EXAMPLE 2

Figure 10:
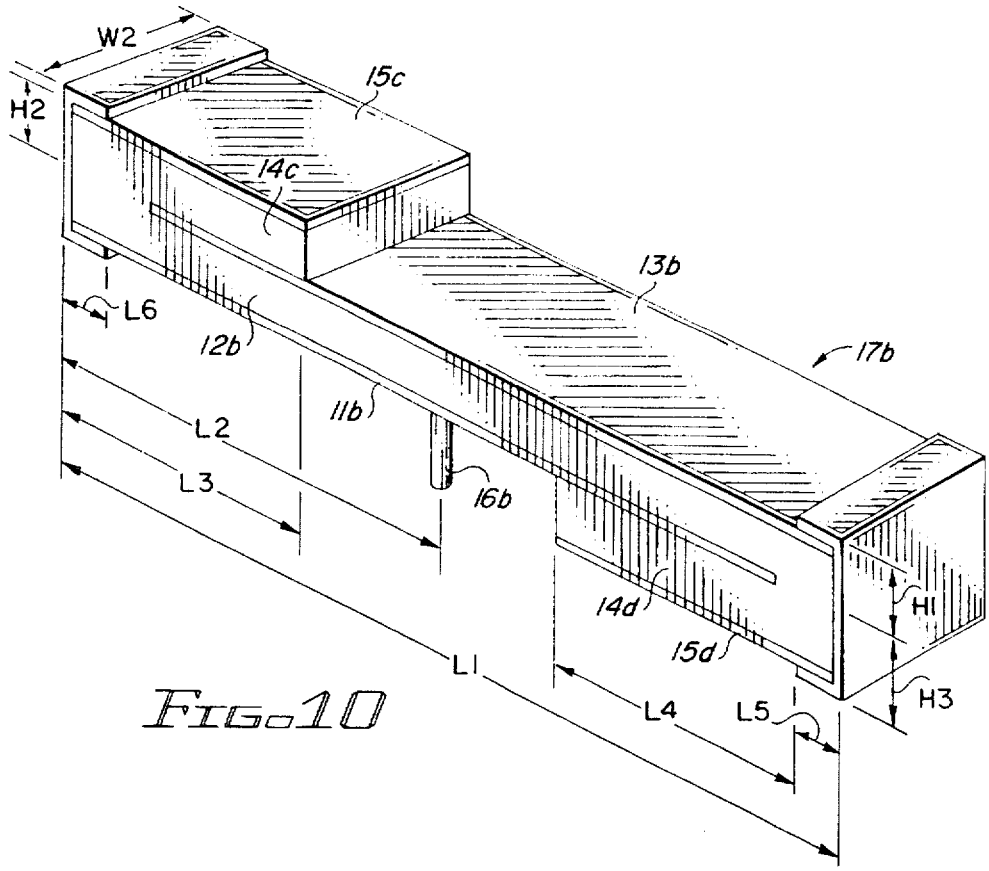
FIG. 10 is a perspective view illustrating an electric/magnetic microstrip antenna in accordance with another embodiment of the present invention.

Referring now to FIG. 10, there is illustrated a perspective view of an electric/magnetic microstrip antenna in accordance with a second embodiment of the present invention.

As shown in FIG. 10, an electric/magnetic antenna 17*b* includes a ground plate 11*b*. A first dielectric substrate 12*b* and a patch radiator 13*b* are sequentially stacked on the ground plate 11*b*. At the left end of the antenna 17*b*, a second dielectric substrate 14*c* and a first parallel plate 15*c* are sequentially stacked on the upper surface of the patch radiator 13*b*; and at the right end of the antenna 17*b*,a third dielectric substrate 14*d*, and a second parallel plate 15*d* are sequentially stacked below the lower surface of the ground plate 11*b*. The outer conductor of a feeder 16*b* is connected with the ground plate 11*b*, and the inner conductor or the feeder 16*b* is connected with the patch radiator 13*b* through the ground plate 11*b*.

In the above construction, dimensions are defined as follows:

- total length L1 or the antenna 17*b*=4.8 cm,
- the length L2 between the left end of the antenna 17*b* and the center of the inner conductor of the feeder 16*b*=1.8 cm,
- the length L3 between the left end of the antenna 17*b* and the right end of the first parallel plate 15*c*=1.6 cm,
- the length L4 between the right end of the antenna 17*b* and the left end of the second parallel plate 15*d*=2.6 cm,
- the length L5, L6 between the left/right end of the patch radiator 13*b* and the left/right end of the antenna 17*b*=0.2 cm,
- the width W1 of the antenna 17*b*=2.1 cm,
- the height H1 between the ground plate 11*b* and the first dielectric substrate 12*b*=0.1575 cm,
- the height H2 between the patch radiator 13*b*, the second dielectric substrate 14*c*, and the first parallel plate 15*c*=0.08 cm, and
- the height H3 between the third dielectric substrate 14*d* and the second parallel plate 15*d*=0.1575 cm.

Figure 11:
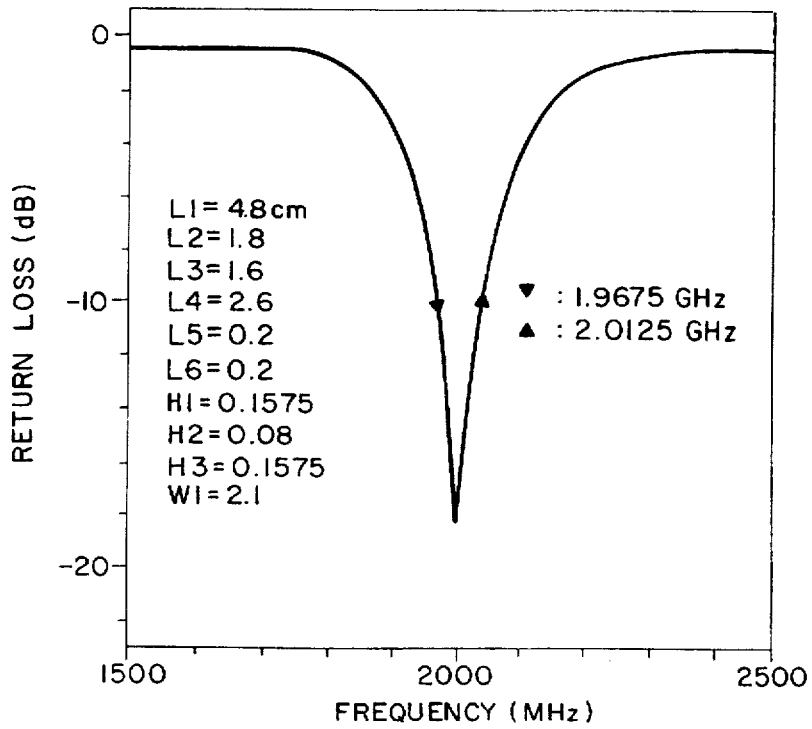
FIG. 11 is a graph showing the return loss property of the electric/magnetic microstrip antenna of FIG. 10.

FIG. 11 shows the return loss property of the electric/magnetic microstrip antenna of FIG. 10; and it is to be understood that when frequency of 2.0 GHz is used, 19 dB is obtained and bandwidth is 3.8%.

EXAMPLE 3

Figure 12:
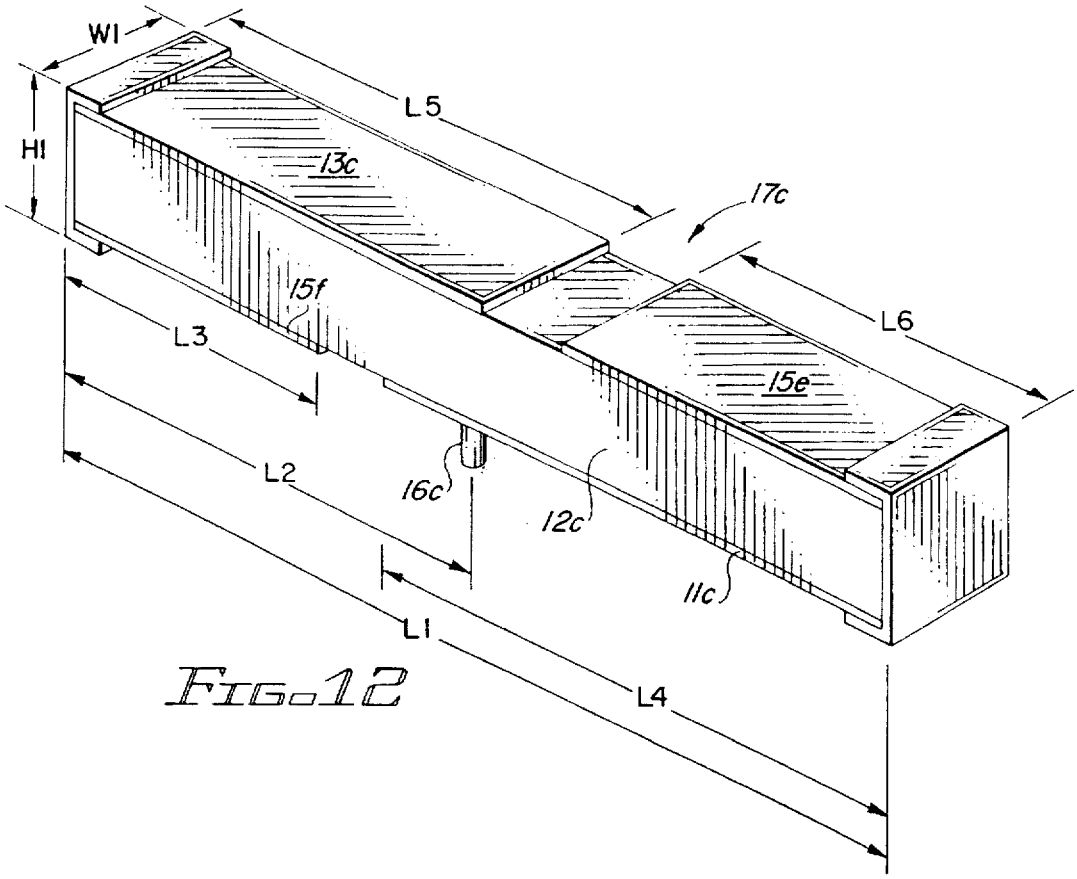
FIG. 12 is a perspective view illustrating an electric/magnetic microstrip antenna in accordance with another embodiment of the present invention.

Referring now to FIG. 12, there is illustrated a perspective view of an electric/magnetic microstrip antenna in accordance with a third embodiment of the present invention.

As shown in FIG. 12, an electric/magnetic antenna 17*c* includes a dielectric substrate 12*c*. A patch radiator 13*c* and a first parallel plate 15*e* are spacedly stacked on the upper surface of the dielectric substrate 12*c*, and a ground plate 11*c* and a second parallel plate 15*f* are spacedly stacked below the lower surface of the dielectric substrate 12*c*. The outer conductor of a feeder 16*c* is connected with the ground plate 11*c*, and the inner conductor of the feeder 16*c* is connected with the patch radiator 13*c* through the ground plate 11*c*.

In the above construction, dimensions are defined as follows:

- total length L1 of the antenna 17*c*=4.5 cm,
- the length L2 between the left end of the antenna 17*c* and the center of the inner conductor of the feeder 16*c*=2.2 cm,
- the length L3 between the left end of the antenna 17*c* and the right end of the second parallel plate 15*f*=1.8 cm,
- the length L4 between the right end of the antenna 17*c* and the left end of the ground plate 11*c*=2.5 cm,
- the length L5 between the left end of the antenna 17*c* and the right end of the patch radiator 13*c*=2.7 cm, the length L6 between the right end of the antenna 17*c* and the left end of the first parallel plate 15*e*=1.3 cm, the width W1 of the antenna 17*c*=2.5 cm, and the height H1 between the ground plate 11*c*, the dielectric substrate 12*c*, and the parallel plate 15*e*=1.3 cm.

Figure 13:
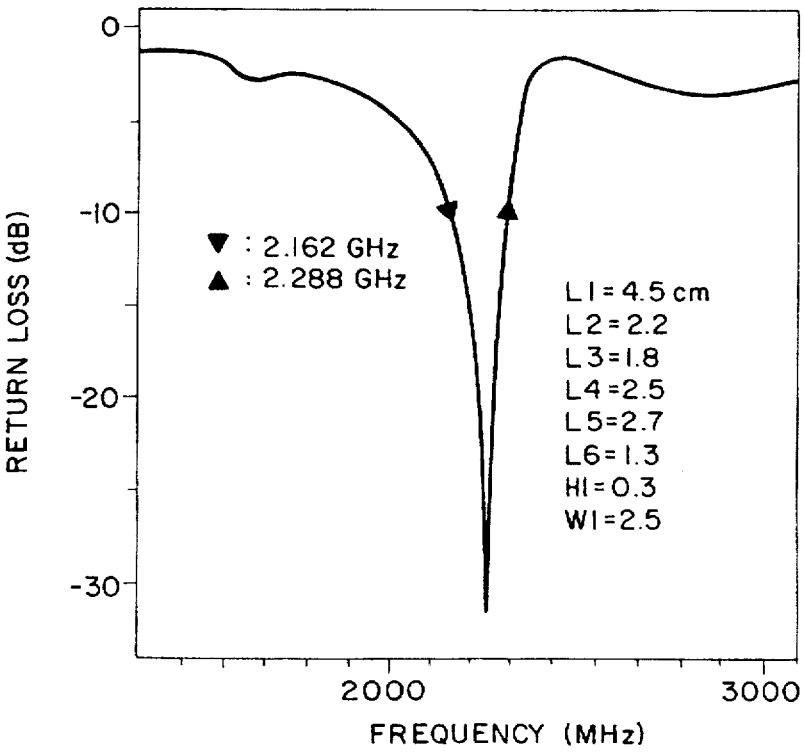
FIG. 13 is a graph showing the return loss property of the electric/magnetic microstrip antenna of FIG. 12.

FIG. 13 shows the return loss property of the electric/magnetic microstrip antenna of FIG. 12; and it is to be understood that when frequency of 2.24 GHz is used, 33 dB is obtained and bandwidth is 5.6%.

EXAMPLE 4

Figure 14:
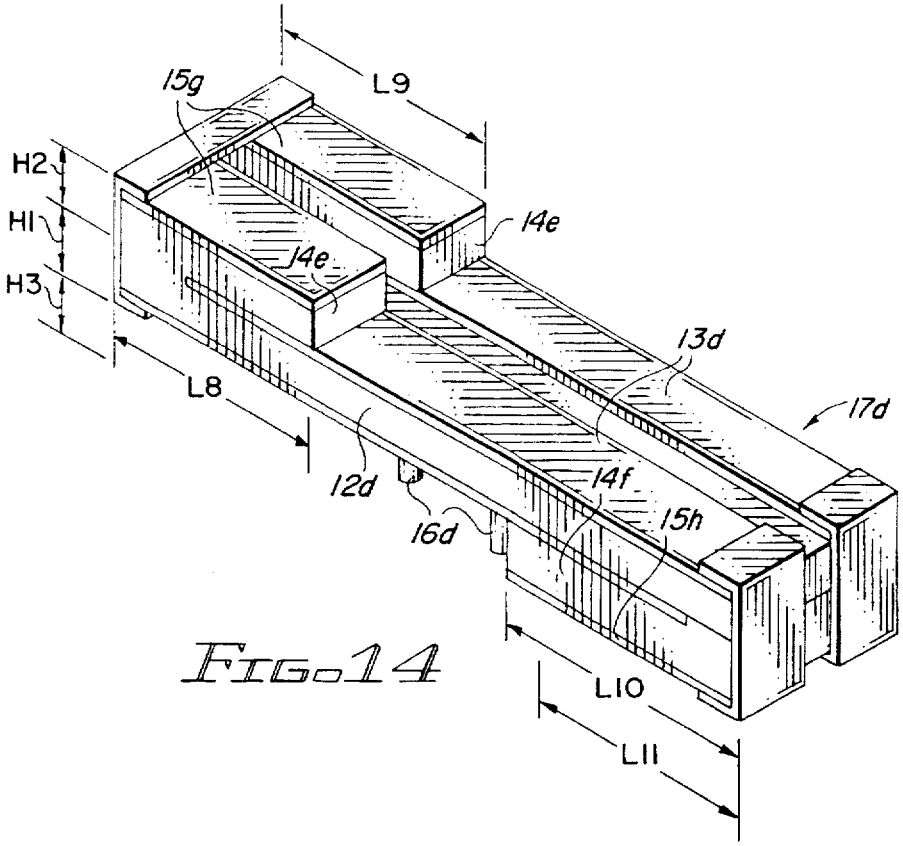
FIG. 14 is a perspective view illustrating an electric/magnetic microstrip antenna in accordance with another embodiment of the present invention.

Referring now to FIG. 14, there is illustrated a perspective view of an electric/magnetic microstrip antenna in accordance with a fourth embodiment of the present invention.

Figure 14A:
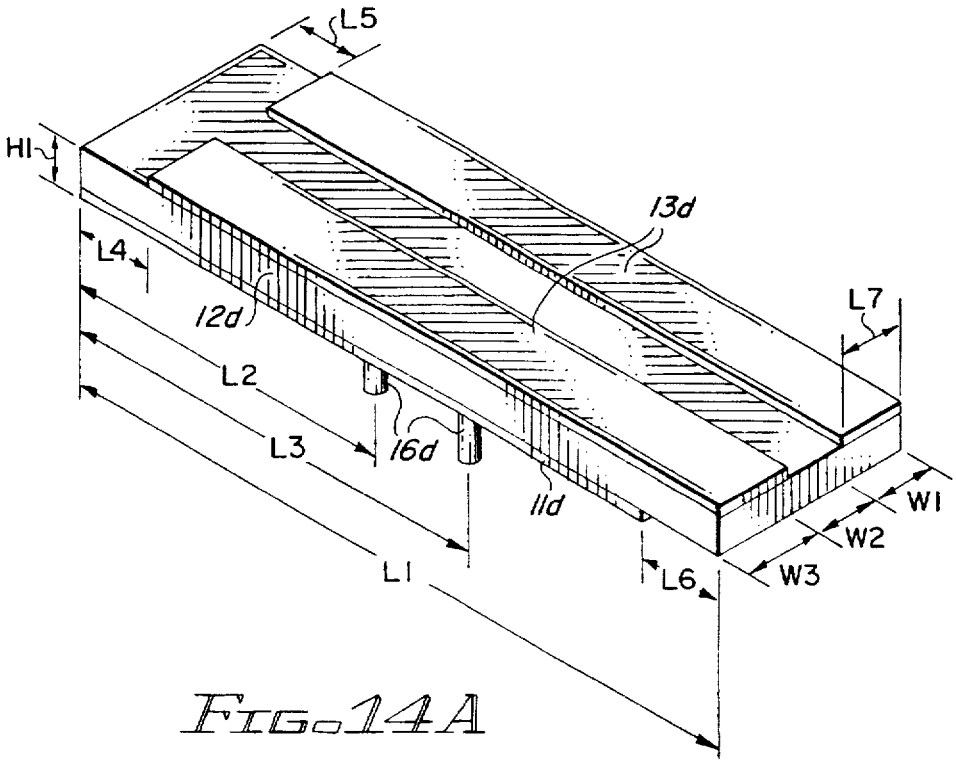
FIG. 14A is a perspective view showing a portion of the electric/magnetic microstrip antenna of FIG. 14 illustrating dimensional parameters.

As shown in FIG. 14 and 14A an electric/magnetic antenna 17*d* includes a ground plate 11*d*. A first dielectric substrate 12*d* and a patch radiator 13*d* are sequentially stacked on the ground plate 11*d*. At the left end of the antenna 17*d*, a second dielectric substrate 14*e* and a first parallel plate 15*g* are sequentially stacked on the upper surface of the patch radiator 13*d*; and at the right end of the antenna 17*d*, a third dielectric substrate 14*f* and a second parallel plate 15*h* are sequentially stacked below the lower surface of the ground plate 11*d*. The outer conductor of a feeder 16*d* is connected with the ground plate 11*d*, and the inner conductor of the feeder 16*d* is connected with the patch radiator 13*d* through the ground plate 11*d*. A pair of the above structures is spacedly provided on the ground plate 11*d*. Accordingly, the antenna of the present embodiment functions as a antenna having two feed points the one of which can be used for transmit and the other one of which can be used for receive. If a 50 Ω chip resistor is provided to one feed point or the one feed point is shorted, the transmit and the receive can be separately performed.

In the above construction, dimensions are defined as follows:

total length L1 of the antenna 17*d*=4.8 cm, the length L2=L3 between the left end of the antenna 17*d* and the center of the inner conductor of the feeder 16*d*=1.8 cm, the length L4=L5 between the left end of the antenna 17*d* and the patch radiator 13*d*=0.2 cm, the length L6=L7 between the right end of the antenna 17*d* and the ground plate 11*d*=0.2 cm, the length L8=1.4L9 between the left end of the antenna 17*d* and the right end of the first parallel plate 15*g*=1.46 cm, the length L10=2.65 L11 between the right end of the antenna 17*d* and the left end of the second parallel plate 15*h*=2.7 cm, the width W1=W3 of the patch radiator 13*d*=1.5 cm, the width W2 between the patch radiators 13*d*=0.45 cm, the height H1 between the ground plate 11*d* and the first dielectric substrate 12*d*=0.1575 cm, the height H2 between the patch radiator 13*d*, the second dielectric substrate 14*e*, and the first parallel plate 15*g*=0.08 cm, and the height H3 between the third dielectric substrate 14*f* and the second parallel plate 15*h*=0.1575 cm.

Figure 15:
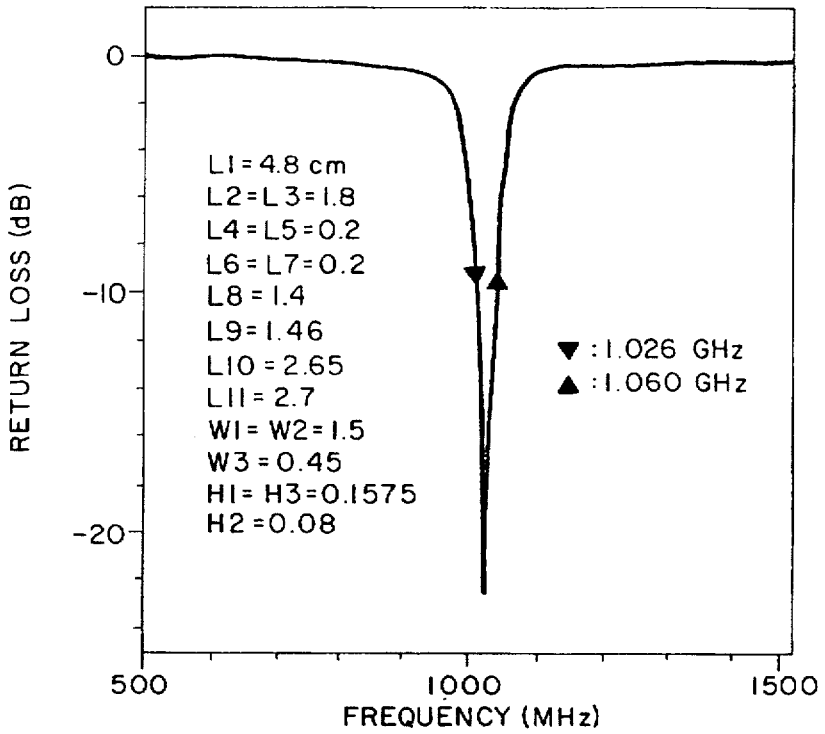
FIG. 15 is a graph showing the return loss property of the electric/magnetic antenna of FIG. 14, when a 50 Ω connector is attached to a L2 feeder.

FIG. 15 shows the return loss property of the electric/magnetic antenna of FIG. 14, measured in a L3 feeder when a 50 Ω connector is attached to a L2 feeder. It is to be understood that bandwidth is 3.3%.

Figure 16:
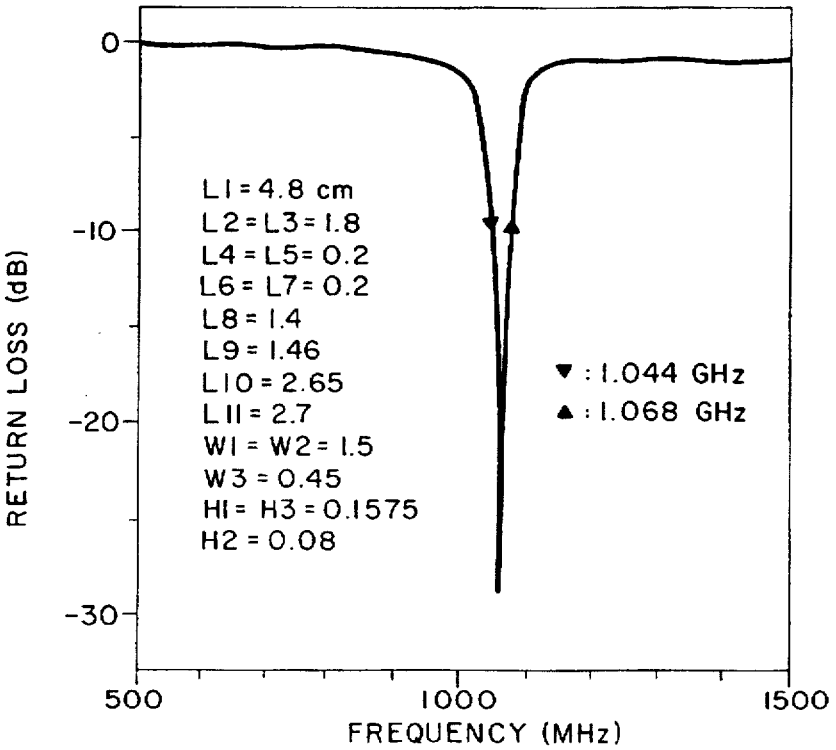
FIG. 16 is a graph showing the return loss property of the electric/magnetic antenna of FIG. 14, when a 50 Ω connector is attached to a L3 feeder.

FIG. 16 shows the return loss property of the electric/magnetic antenna of FIG. 14, measured in the L2 feeder when a 50 Ω connector is attached to the L3 feeder. It is to be understood that bandwidth is 2.3%.

Figure 17:
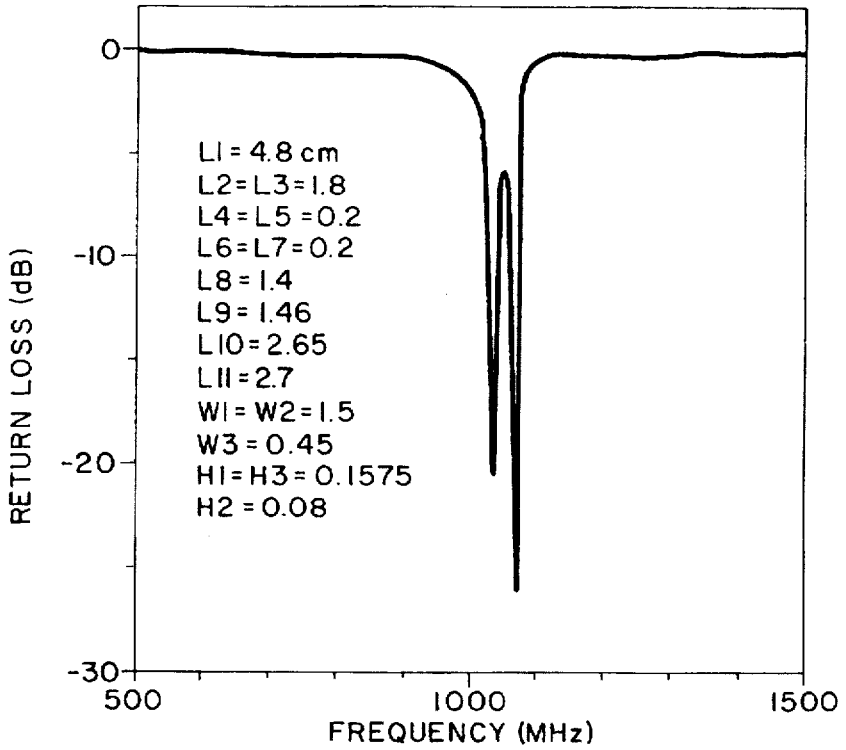
FIG. 17 is a graph showing the return loss property of the electric/magnetic antenna of FIG. 14, when the L2 feeder is opened.

FIG. 17 shows the return loss property of the electric/magnetic antenna of FIG. 14, measured in the L3 feeder when the L2 feeder is opened.

Figure 18:
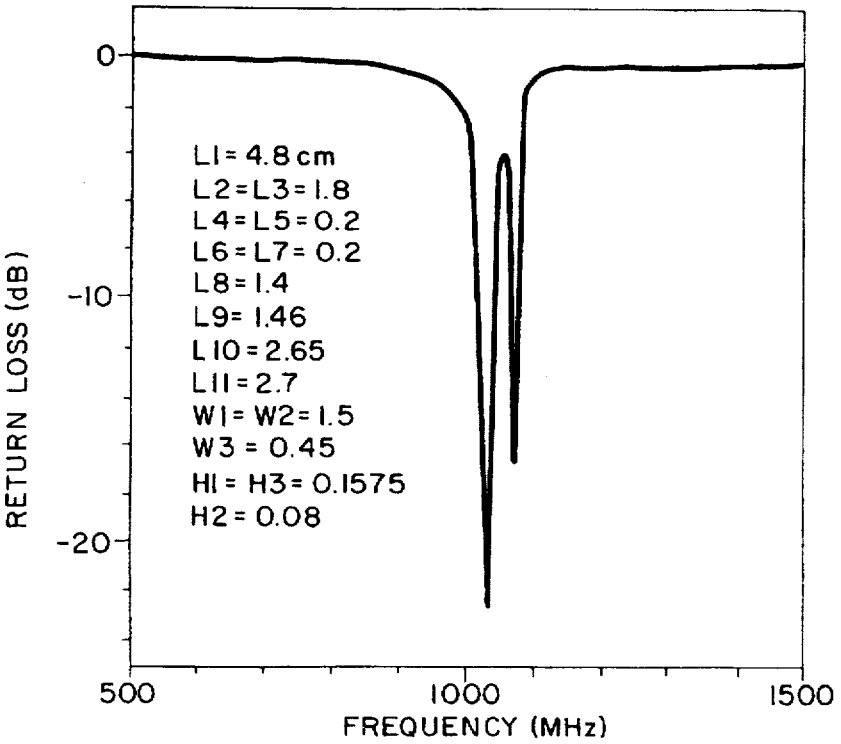
FIG. 18 is a graph showing the return loss property of the electric/magnetic antenna of FIG. 14, when the L3 feeder is opened.

FIG. 18 shows the return loss property of the electric/magnetic antenna of FIG. 14, measured in the L2 feeder when the L3 feeder is opened.

EXAMPLE 5

Figure 19:
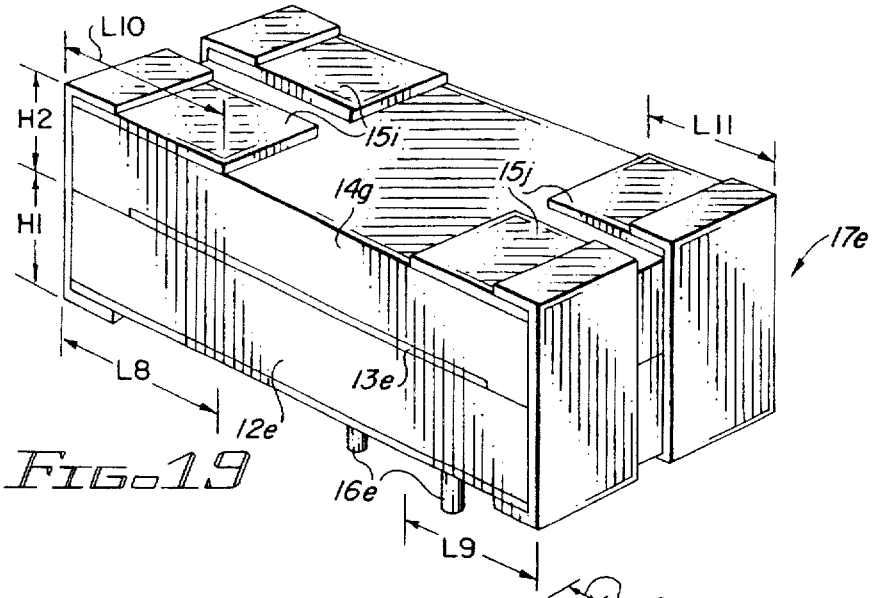
FIG. 19 is a perspective view illustrating an electric/magnetic microstrip antenna in accordance with another embodiment of the present invention.

Referring now to FIG. 19, there is illustrated a perspective view of an electric/magnetic microstrip antenna in accordance with a fifth embodiment of the present invention.

Figure 19A:
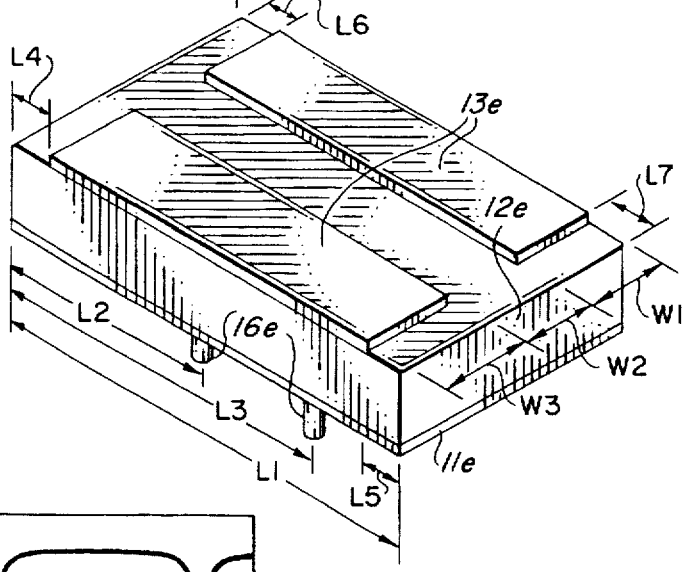
FIG. 19A is a perspective view showing a portion of the electric/magnetic microstrip antenna of FIG. 14 illustrating dimensional parameters.

As shown in FIG. 19 and 19A electric/magnetic antenna 17*e* includes a ground plate 11*e*. A first dielectric substrate 12*e* and a patch radiator 13*e* are sequentially stacked on the ground plate 11*e*. A second dielectric substrate 14*g* and left/right parallel plates 15*i*, 15*j* are sequentially stacked on the upper surface of the patch radiator 13*e*. The outer conductor of a feeder 16*e* is connected with the ground plate 11*e*, and the inner conductor of the feeder 16*e* is connected with the patch radiator 13*e* through the ground plate 11*e*. A pair of above structures is spacedly provided on the ground plate 11*e*. Accordingly, the antenna of the present embodiment functions as a antenna having two feed points the one of which can be used for transmit and the other one of which can be used for receive. When a 50 Ω chip resistor is provided to one feed point or the one feed point is shorted, the transmit and the receive can be separated performed.

In the above construction, dimensions are defined as follows:

total length L1 of the antenna 17*e*=4.55 cm, the length between the left end of the antenna 17*c* and the center of the inner conductor of the each feeder 16*e* L2=2 cm and L3=2.3 cm, the length L4=L5=L6=L7 between the left/right end of the patch radiator 13*c* and the left/right end of the antenna 17*e*=0.3 cm, the length between the left end of the antenna 17*e* and the right end of the left parallel plates 15*i* L8=1.8 cm and L10=1.1 cm, the length between the right end of the antenna 17*e* and the left end of the right parallel plates 15*j* L9=2.4 cm and L11=1.45 cm, the width W1 =W2 of the patch radiator 13*e*=1.15 cm, the width W3 between the patch radiators 13*e*=0.2 cm, the height H1 of the ground plate 11*e*, the first dielectric substrate 12*e*, and the patch radiator 13*e*=0.3 cm, and the height H2 of the second dielectric substrate 14*g* and the right parallel plate 15*j*=0.1575 cm.

Figure 20:
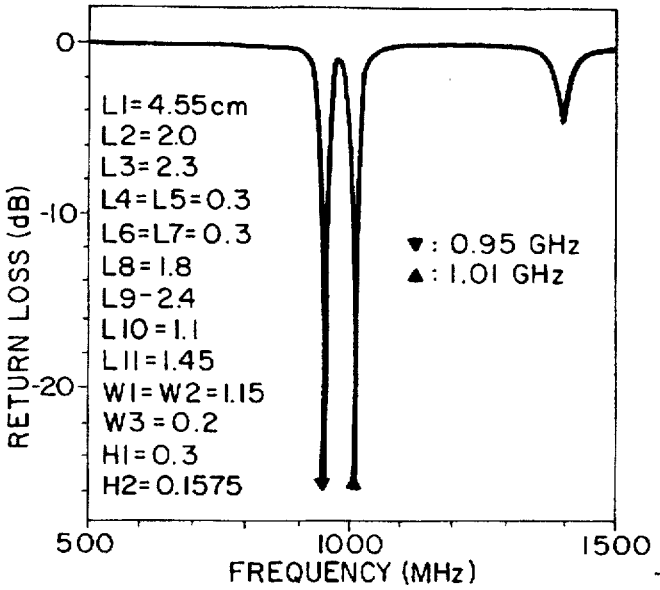
FIG. 20 is a graph showing the return loss property of the electric/magnetic microstrip antenna of FIG. 19.

FIG. 20 shows the return loss property of the electric/magnetic antenna of FIG. 19, measured in a L3 feeder when a L2 feeder is shorted. It is to be understood that when frequency of 0.95 GHz is used, 25 dB is obtained, and when frequency of 1.01 GHz is used, 24 dB is obtained.

EXAMPLE 6

Figure 21:
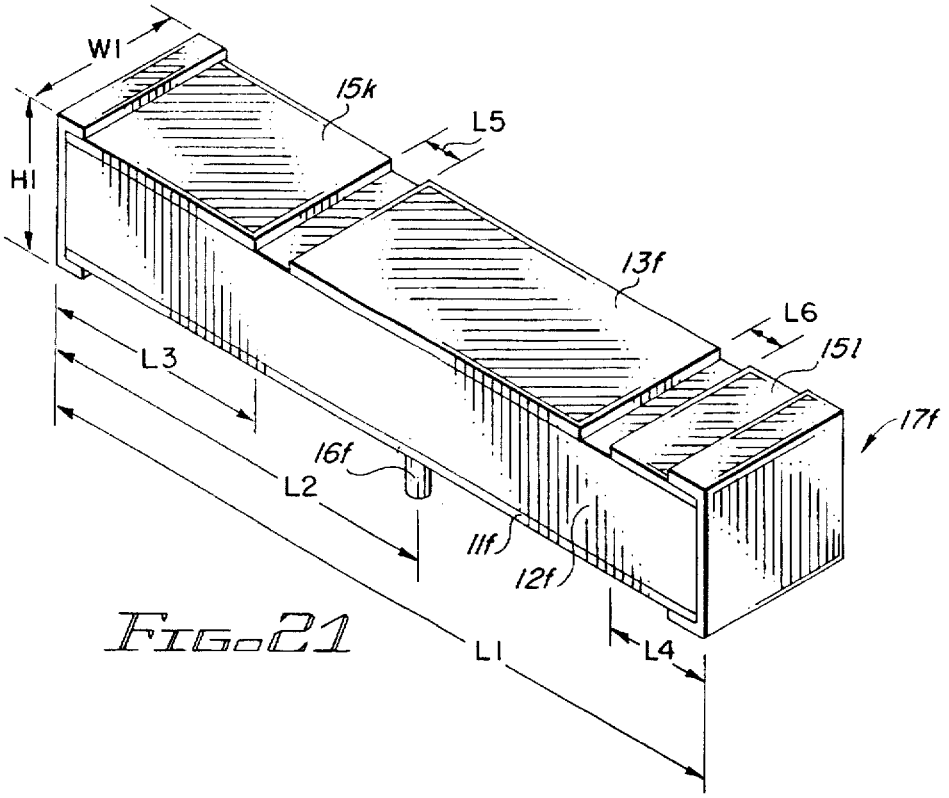
FIG. 21 is a perspective view illustrating an electric/magnetic microstrip antenna in accordance with another embodiment of the present invention.

Referring now to FIG. 21, there is illustrated a perspective view of an electric/magnetic microstrip antenna in accordance with a sixth embodiment of the present invention.

As shown in FIG. 21, an electric/magnetic antenna 17*f* includes a dielectric substrate 12*f*. A patch radiator 13*f* and left/right parallel plate 15*k*, 151 spaced each other are sequentially stacked on the upper surface of the dielectric substrate 12f. The outer conductor of a feeder 16f is connected with a ground plate 11f, and the inner conductor of the feeder 16f is connected with the patch radiator 13f through the ground plate 11f. Accordingly, the antenna of the present embodiment can be fabricated in a easy manner and has a simple structure. Since the antenna of the present embodiment has a symmetrical construction, the leaking current cannot be flowed into the outer conductor of the coaxial cable of the feeder 16f. Accordingly, when the antenna is installed to a portable mobile communication system, a matching circuit is not needed. Also, the antenna can cover wide band to overcome narrow band problem.

In the above construction, dimensions are defined as follows:

total length L1 of the antenna 17f=4.6 cm, the length L2 between the left end of the antenna 17f and the center of the inner conductor of the feeder 16f=1.5 cm, the length L3 between the left end of the antenna 17f and the right end of the left parallel plate 15k=0.5 cm, the length L4 between the right end of the antenna 17f and the left end of the right parallel plate 151=0.55 cm, the length L5 between the left parallel plate 15k and the left end of the patch radiator 13f=0.05 cm, the Length L6 between the right parallel plate 151 and the right end of the patch radiator 13f=0.03 cm, the width W1 of the antenna 17f=2.5 cm, and the height H1 between the ground plate 11f, the dielectric substrate 12f, and the patch radiator 13f=0.3 cm.

Figure 22:
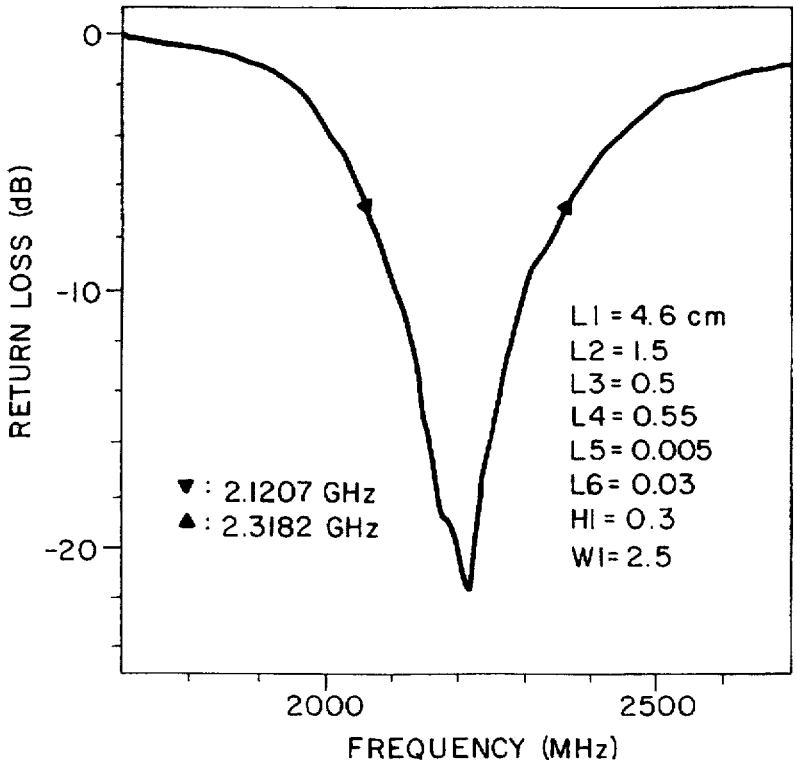
FIG. 22 is a graph showing the return loss property of the electric/magnetic microstrip antenna of FIG. 21.

FIG. 22 shows the return loss property of the electric/magnetic antenna of FIG. 21. It is to be understood that when frequency of 2.2 GHz is used, 22 dB is obtained and bandwidth is 8.9%.

EXAMPLE 7

Figure 23:
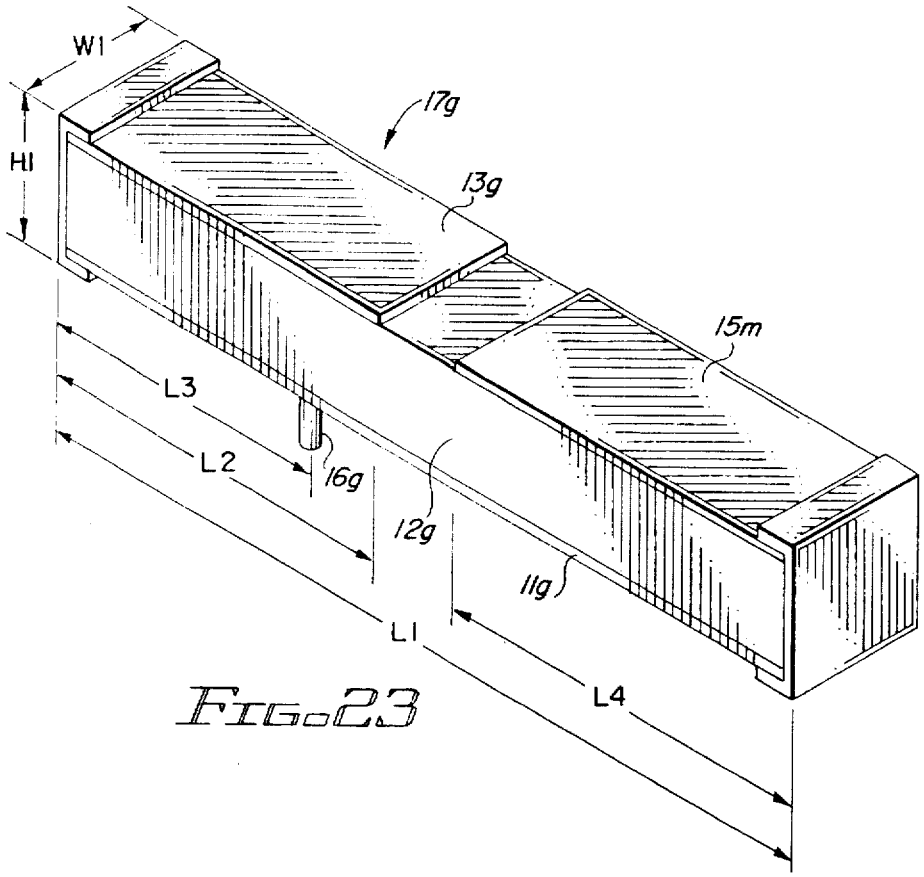
FIG. 23 is a perspective view illustrating an electric/magnetic microstrip antenna in accordance with another embodiment of the present invention.

Referring now to FIG. 23, there is illustrated a perspective view of an electric/magnetic microstrip antenna in accordance with a seventh embodiment of the present invention.

As shown in FIG. 23, an electric/magnetic antenna 17g includes a ground plate 11g, a dielectric substrate 12g stacked on the ground plate 11g, a patch radiator 13g and a parallel plate 15m spacedly stacked on the upper surface of the dielectric substrate 12g. The outer conductor of a feeder 16g is connected with a ground plate 11g, and the inner conductor of the feeder 16g is connected with the patch radiator 13g through the ground plate 11g. Accordingly, the antenna of the present embodiment can be fabricated in a easy manner and has a simple structure.

In the above construction, dimensions are defined as follows:

total length L1 of the antenna 17f=4.15 cm, the length L2 between the left end of the antenna 17g and the right end of the patch radiator 13g=1.5 cm, the length L3 between the left end of the antenna 17g and the center of the inner conductor of the feeder 16g=2.05 cm, the length L4 between the right end of the antenna 17g and the left end of the right parallel plate 15m=1.7 cm, the width W1 of the antenna 17f=2.6 cm, and the height H1 between the ground plate i lg, the dielectric substrate 12g, and the patch radiator 13g=0.3 cm.

Figure 24:
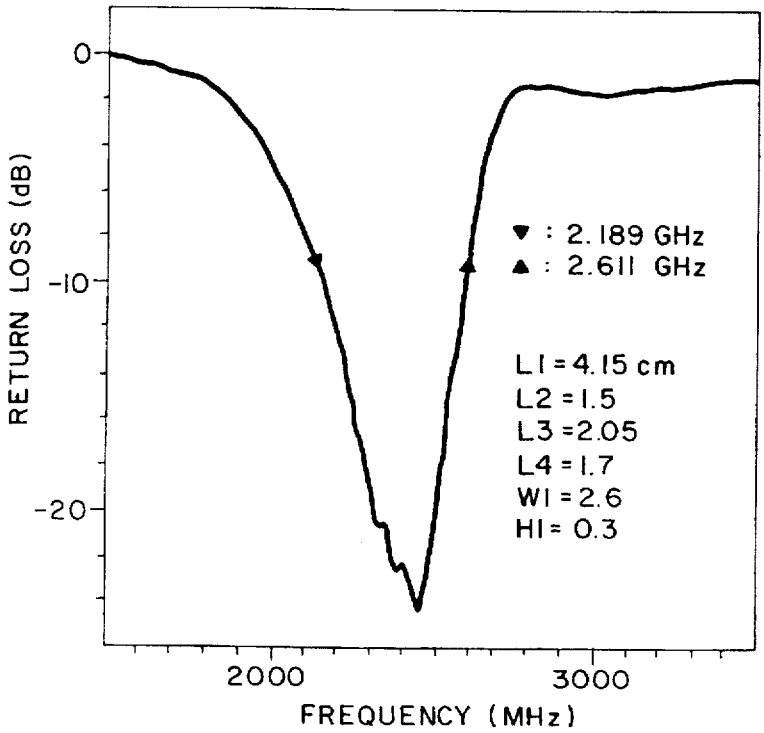
FIG. 24 is a graph showing the return loss property of the electric/magnetic microstrip antenna of FIG. 23.

FIG. 24 shows the return loss property of the electric/magnetic antenna of FIG. 23. It is to be understood that when frequency of 2.4 GHz is used, 25 dB is obtained and bandwidth is 17.5%.

EXAMPLE 8

Figure 25:
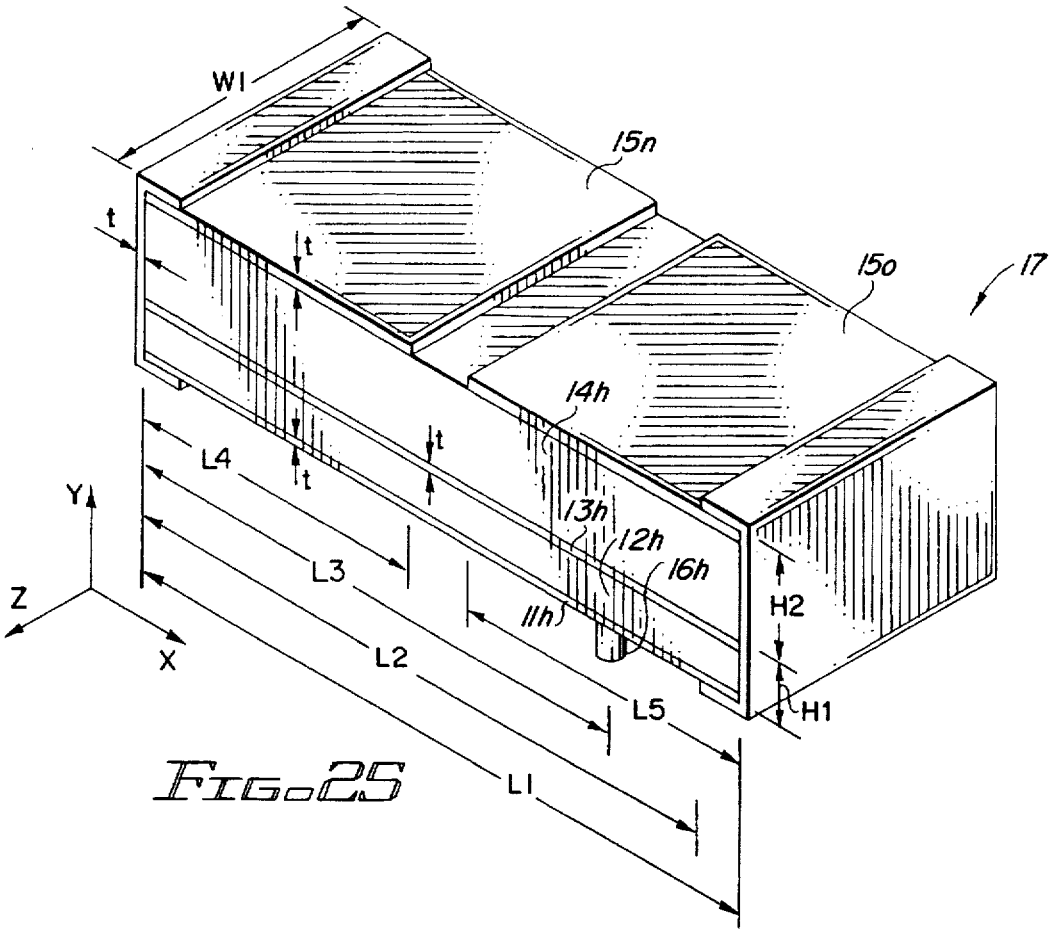
FIG. 25 is a perspective view illustrating an electric/magnetic microstrip antenna in accordance with still another embodiment of the present invention.

Referring now to FIG. 25, there is illustrated a perspective view of an electric/magnetic microstrip antenna in accordance with an eighth embodiment of the present invention.

As shown in FIG. 25, an electric/magnetic antenna 17h includes a ground plate 11h. A first dielectric substrate 12h and a patcht radiator 13h are sequentially stacked on the ground plate 11h. A second dielectric substrate 14h is stacked on the patch radiator 13h, and parallel plates 15n, 15o having same width are spacedly stacked on the second dielectric substrate 14h. The outer conductor of a feeder 16h is connected with the ground plate 11h, and the inner conductor of the feeder 16h is connected with the patch radiator 13h through the ground plate 11h. The left end of the ground plate 11h and the patch radiator 13h are shorted electrically each other. Since the space between the ground plate 11h and the patch radiator 13h functions as a stub and parallel plates 15n and 11o have an approximate symmetrical construction, the leaking current cannot be flowed into the outer conductor of the coaxial cable of the feeder 16h. Accordingly, when the antenna is installed to a portable mobile communication system, a matching circuit is not needed.

In the above construction, dimensions are defined as follows:

the thickness t of the ground plate 11h, the patch radiator 13h, and the left/right parallel plate 15n, 15o=0.0035 cm, total length L1 of the antenna 17h=3.0 cm, the length L2 between the left end of the antenna 17h and the right end of the patch radiator 13h=2.7 cm, the length L3 between the left end of the antenna 17h and the center of the inner conductor of the feeder 16h=2.0 cm, the length L4 between the left end of the antenna 17h and the right end of the left parallel plate 15n=1.48 cm, the length L5 between the right end of the antenna 17h and the left end of the right parallel plate 15o=1.48 cm, the width W1 of the antenna 17h=2.5 cm, the height H1 between the ground plate 11h, the first dielectric substrate 12h, and the patch radiator 13h=0.1575 cm, the height H2 between the second dielectric substrate 14h and the parallel plate 15a, 15b=0.4725 cm, and frequency f=2.0 GHz(λ=15 cm).

Figure 26:
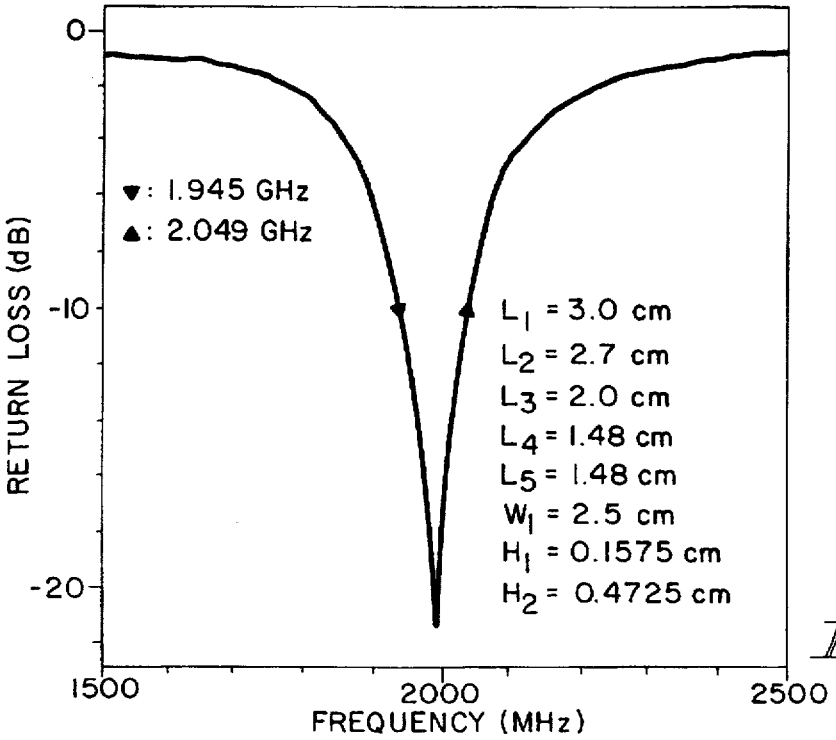
FIG. 26 is a graph showing the return loss property of the electric/magnetic microstrip antenna of FIG. 25.

FIG. 26 shows the return loss property of the electric/magnetic microstrip antenna of FIG. 25. It is to be understood that when frequency of 2.0 GHz is used, 22 dB is obtained and bandwidth is 5.2%.

As described above, according to the present invention, there is provided a microstrip antenna which can be miniaturized by the fact that the ground plate and the patch radiator have the same width and the left/right parallel plates are formed by folding both ends of the ground plate or by folding one end of the ground plate and one end of the patch radiator, function as an electric/magnetic antenna of a micro-spherical loop structure to generate vertically/horizontally polarized waves, overcome the standing wave distribution due to the multipath interference, resolve the lower receive sensitivity by using the polarization diversity, function to transmit and receive, and eliminate the need of a matching circuit.

Although the present invention has been described and illustrated with reference to the preferred embodiments, it is to be readily understood that the present invention is not limited to the preferred embodiments, and various changes and modifications can be made without departing from the scope and spirit of the invention defined in the appended claims.

What is claimed is:

1. Electric/magnetic microstrip antenna comprising:

a ground plate having first and second opposite ends;

a first dielectric substrate and a patch radiator sequentially stacked on the ground plate; and a second dielectric substrate and a pair of parallel plates which are spaced from each other, sequentially stacked on the patch radiator to form a capacitance between the patch radiator and the respective parallel plates;

wherein the ground plate and the patch radiator have the same width, and wherein the pair of parallel plates are respectively connected to the first and second opposite ends of the ground plate such that the size of the electric/magnetic microstrip antenna is reduced while the range of electric lines of force between the patch radiator and the ground plate is not restricted.

2. Electric/magnetic microstrip antenna comprising:

a ground plate;

a first dielectric substrate and a patch radiator sequentially stacked on the ground plate;

a second dielectric substrate and a first parallel plate sequentially stacked on the upper surface of the patch radiator adjacent one end of the antenna, to form a capacitance between the patch radiator and the first parallel plate; and a third dielectric substrate and a second parallel plate sequentially stacked below the lower surface of the ground plate adjacent the other end of the antenna, to form a capacitance between the ground plate and the second parallel plate;

wherein the ground plate and the patch radiator have the same width, and wherein the first parallel plate is connected to one end of the ground plate and the second parallel plate is connected to one end of the patch radiator such that the size of the electric/magnetic microstrip antenna is reduced while the range of electric lines of force between the patch radiator and the ground plate is not restricted.

3. Electric/magnetic microstrip antenna comprising:

a dielectric substrate;

a patch radiator and a first parallel plate spacedly stacked on the upper surface of the dielectric substrate to form a capacitance therebetween; and a ground plate and a second parallel plate spacedly stacked below the lower surface of the dielectric substrate to form a capacitance therebetween;

wherein the ground plate and the patch radiator have the same width, and wherein the first parallel plate is connected to one end of the ground plate and the second parallel plate is connected to one end of the patch radiator such that the size of the electric/magnetic microstrip antenna is reduced while the range of electric lines of force between the patch radiator and the ground plate is not restricted.

4. Electric/magnetic microstrip antenna comprising:

a ground plate;

a first dielectric substrate and a pair of patch radiators which are spaced from each other, sequentially stacked on the ground plate;

a pair of second dielectric substrates and a pair of first parallel plates sequentially stacked on the upper surface of the respective patch radiator adjacent one end of the antenna, to form a capacitance between the patch radiators and the first parallel plates; and a pair of third dielectric substrates and a pair of second parallel plates sequentially stacked below the lower surface of the ground plate adjacent the other end of the antenna, to form a capacitance between the ground plate and the respective second parallel plates, wherein the first parallel plates are connected to one end of the ground plate and the second parallel plates are connected to one end of the patch radiator such that the size of the electric/magnetic microstrip antenna is reduced while the range of electric lines of force between the patch radiator and the ground plate is not restricted.

5. Electric/magnetic microstrip antenna comprising:

a ground plate;

a first dielectric substrate and a patch radiator sequentially stacked on the ground plate; and a second dielectric substrate and two pairs of parallel plates which are opposedly spaced from each other, sequentially stacked on the upper surface of the patch radiator to form a capacitance between the patch radiator and the respective parallel plates;

wherein the ground plate and the patch radiator have the same width, and wherein the two pairs of parallel plates are respectively connected to respective ends of the ground plate such that the size of the electric/magnetic microstrip antenna is reduced while the range of electric lines of force between the patch radiator and the ground plate is not restricted.

6. Electric/magnetic microstrip antenna comprising:

a ground plate;

a dielectric substrate stacked on the ground plate;

a pair of parallel plates which are stacked on the dielectric substrate and spaced from each other; and a patch radiator which is stacked on the dielectric substrate and positioned between the parallel plates to form a capacitance between the parallel plates and the patch radiator;

wherein the ground plate and the patch radiator have the same width, and wherein the parallel plates are respectively connected to respective ends of the ground plate such that the size of the electric/magnetic microstrip antenna is reduced while the range of electric lines of force between the patch radiator and the ground plate is not restricted.

7. Electric/magnetic microstrip antenna comprising:

a ground plate;

a dielectric substrate stacked on the ground plate; and a patch radiator and a parallel plate spacedly stacked on the upper surface of the dielectric substrate to form a capacitance therebetween;

wherein the ground plate and the patch radiator have the same width, and wherein the parallel plate is connected to one end of the ground plate and the patch radiator is connected to the other end of the ground plate such that the size of the electric/magnetic microstrip antenna is reduced while the range of electric lines of force between the patch radiator and the ground plate is not restricted.

8. Electric/magnetic microstrip antenna comprising:

a ground plate;

a first dielectric substrate and a patch radiator sequentially stacked on the ground plate, one end of the ground plate being shorted electrically; and a second dielectric substrate and a pair of parallel plates which are spaced from each other, sequentially stacked on the patch radiator to form a capacitance between the two parallel plates;

wherein the ground plate and the patch radiator have the same width, and wherein the parallel plates are respectively connected to respective ends of the ground plate such that the size of the electric/magnetic microstrip antenna is reduced while the range of electric lines of force between the patch radiator and the ground plate is not restricted.

* * * * *